US005320317A

United States Patent [19]

Hyatt

[11] Patent Number: 5,320,317

[45] **Date of Patent: * Jun. 14, 1994**

[54] WRIST AND FOREARM SUPPORT APPARATUS

[76] Inventor: Robert G. Hyatt, 3505 S. Frick Av., Tucson, Ariz. 85730

[ * ] Notice: The portion of the term of this patent subsequent to Dec. 17, 2009 has been disclaimed.

[21] Appl. No.: 802,200

[22] Filed: Dec. 4, 1991

Related U.S. Application Data

[63] Continuation of Ser. No. 586,071, Sep. 21, 1990, Pat. No. 5,072,905.

[51] Int. Cl.[5] ..... F10M 11/20

[52] U.S. Cl. ..... 248/118.1; 248/118.5; 400/715

[58] Field of Search ..... 248/118, 118.1, 118.2, 248/118.3, 282, 918; 108/90; 297/174, 411, 413, 415, 416; 400/715

[56] References Cited

U.S. PATENT DOCUMENTS

| | | | |
|---|---|---|---|
| 459,134 | 9/1891 | Davis . | |
| 1,516,795 | 11/1924 | Schwarting . | |
| 1,721,221 | 7/1929 | Jauregui . | |
| 1,731,709 | 10/1929 | Cropsey . | |
| 1,737,350 | 11/1929 | Balcer . | |
| 2,477,898 | 8/1949 | Rehman et al. . | |
| 2,602,488 | 7/1952 | Conning . | |
| 2,950,890 | 8/1960 | Hough . | |
| 4,576,351 | 3/1986 | Brink . | |
| 4,621,781 | 5/1985 | Springer . | |
| 4,913,390 | 4/1990 | Berke . | |
| 4,997,054 | 3/1991 | Denny et al. | 248/118 X |
| 5,072,905 | 12/1991 | Hyatt | 248/118 |
| 5,158,256 | 10/1992 | Gross | 248/118.3 |

FOREIGN PATENT DOCUMENTS

| | | |
|---|---|---|
| 45675 | of 1932 | Denmark . |
| 42022 | of 1964 | Fed. Rep. of Germany . |
| 1913287 | of 1970 | Fed. Rep. of Germany . |
| 2203265 | of 1972 | Fed. Rep. of Germany . |
| 2074948 | of 1981 | United Kingdom . |

OTHER PUBLICATIONS

"Desk-Rest"; LMB Hand Rehab Products, Inc.; P.O. Box 1181, San Luis Obispo, Calif. 93406.

*Primary Examiner*—David A. Scherbel
*Assistant Examiner*—Derek J. Berger
*Attorney, Agent, or Firm*—Leydig, Voit & Mayer

[57] ABSTRACT

A wrist and forearm support apparatus for use at a desk or table to prevent overuse of the forearm muscles and to prevent nerve compression at the wrist of individuals performing typing or other keying activities. The wrist and forearm support apparatus comprises a cushioned wrist support member having a pair of cushioned armrest members pivotably connected thereto for adjustment to angular positions providing optimal support for an individual user, and a clamping mechanism disposed at forward ends of the armrest support members for attaching the wrist support member and the armrest as a unitary structure to an edge of the table.

6 Claims, 2 Drawing Sheets

WRIST AND FOREARM SUPPORT APPARATUS

This application is a continuation of application Ser. No. 07/586,071, filed Sep. 21, 1990, now U.S. Pat. No. 5,072,905.

TECHNICAL FIELD

This invention relates to apparatus for forearm and wrist support of individuals while working at a desk or table.

BACKGROUND OF THE INVENTION

Individuals who spend long hours typing on a keyboard or performing similar desk duties often suffer from Cumulative Repetitive Stress Syndromes such as Tendonitis, Carpal Tunnel Syndrome and general tissue pain, all due to lack of wrist and forearm support. Increased instances of excessive mechanical stress in the shoulders can also be a product of improper wrist and forearm support.

Heretofore, arm and wrist support apparatus have been designed to accommodate either the arm or the wrist, but are not designed to accommodate both. Some devices are fixed to a particular machine, while others require cumbersome gear for attaching them to either a keyboard or the supporting structure for the keyboard.

SUMMARY OF THE INVENTION

The principal object of this invention is to provide apparatus which supports both arms and wrists of an individual performing keying and typing tasks at a computer terminal to prevent overuse of the forearm muscles and to prevent nerve compression at the wrist.

It is a related object of this invention to provide a unitary wrist and forearm support apparatus which is attachable to a table or desk and which provides support for both the forearm and the wrist, and which is adjustable to the optimal position of the individual who is performing keying and typing activities.

It is a further object of this invention to provide a wrist and forearm support apparatus that is readily and easily attachable to desks or tables of different thicknesses.

These and other objects are satisfied by a wrist and forearm support apparatus comprising:

a cushioned wrist support member;

a pair of spaced cushioned armrest members pivotably connected adjacent forward ends to the wrist support member and extending perpendicularly from said wrist support member;

a clamping mechanism carried by the wrist support member and the armrest members to clamp the members to a support, the wrist support member having cushioned portions arranged generally adjacent to forward ends of the armrest support members and having a structural element interconnecting the armrest support members to form a unitary structure.

DETAILED DESCRIPTION OF THE BEST MODE

Figure 1:
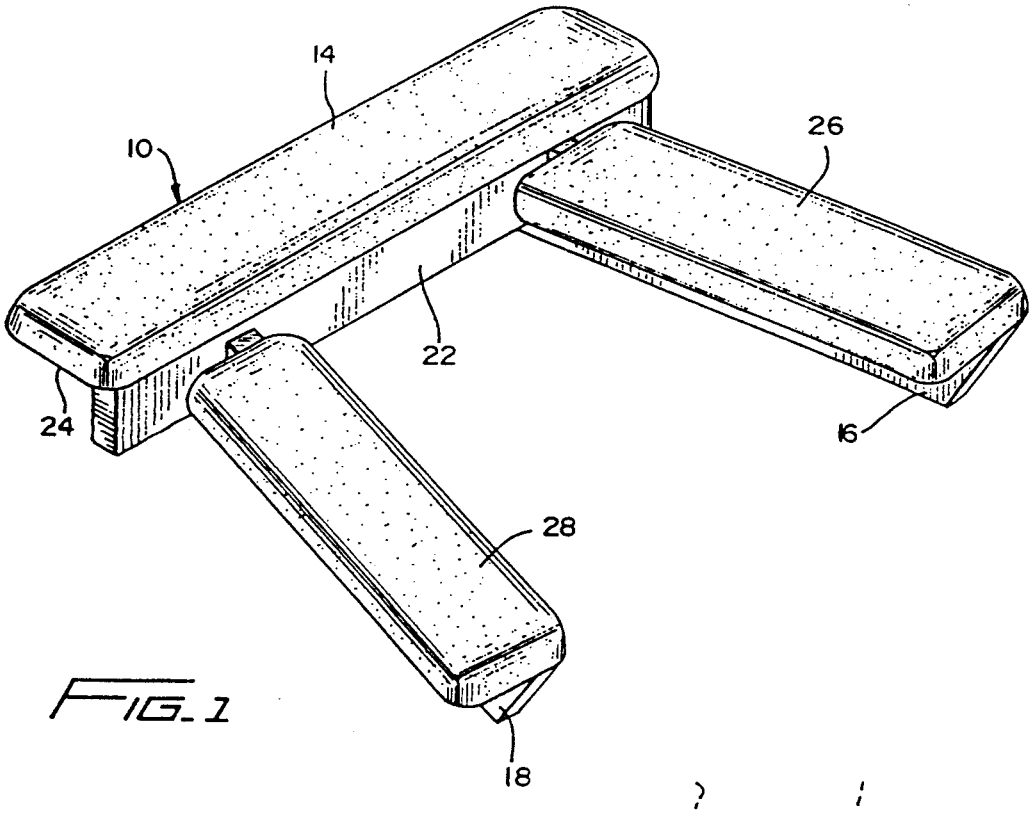
FIG. 1 is a perspective view of the wrist and forearm support apparatus of the instant invention showing angular displacement of the forearm support members.
Figure 3:
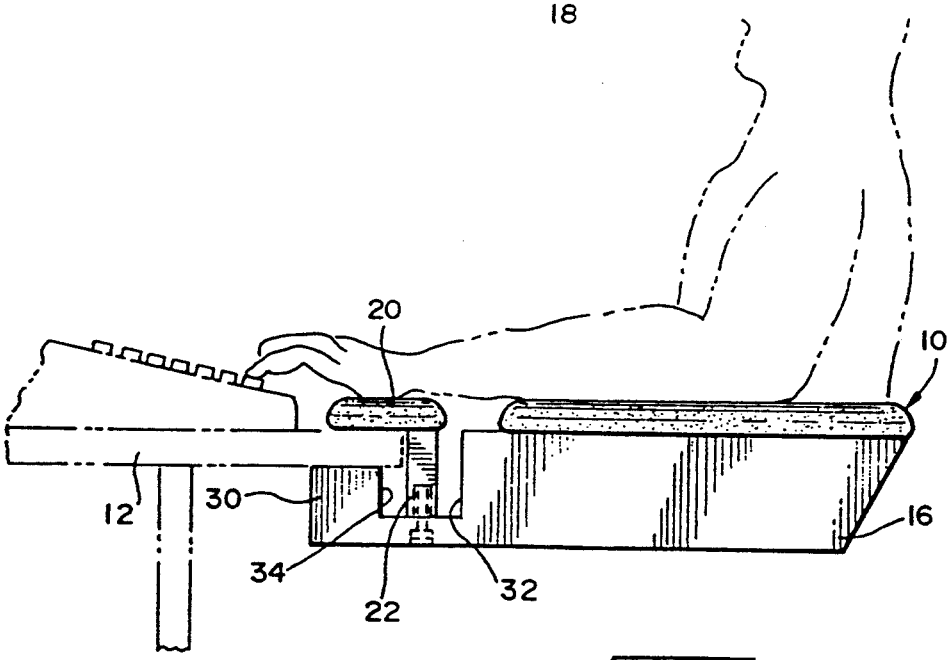
FIG. 3 is an overall view illustrating a typical use for the wrist and forearm support apparatus of the instant invention.
Figure 2:
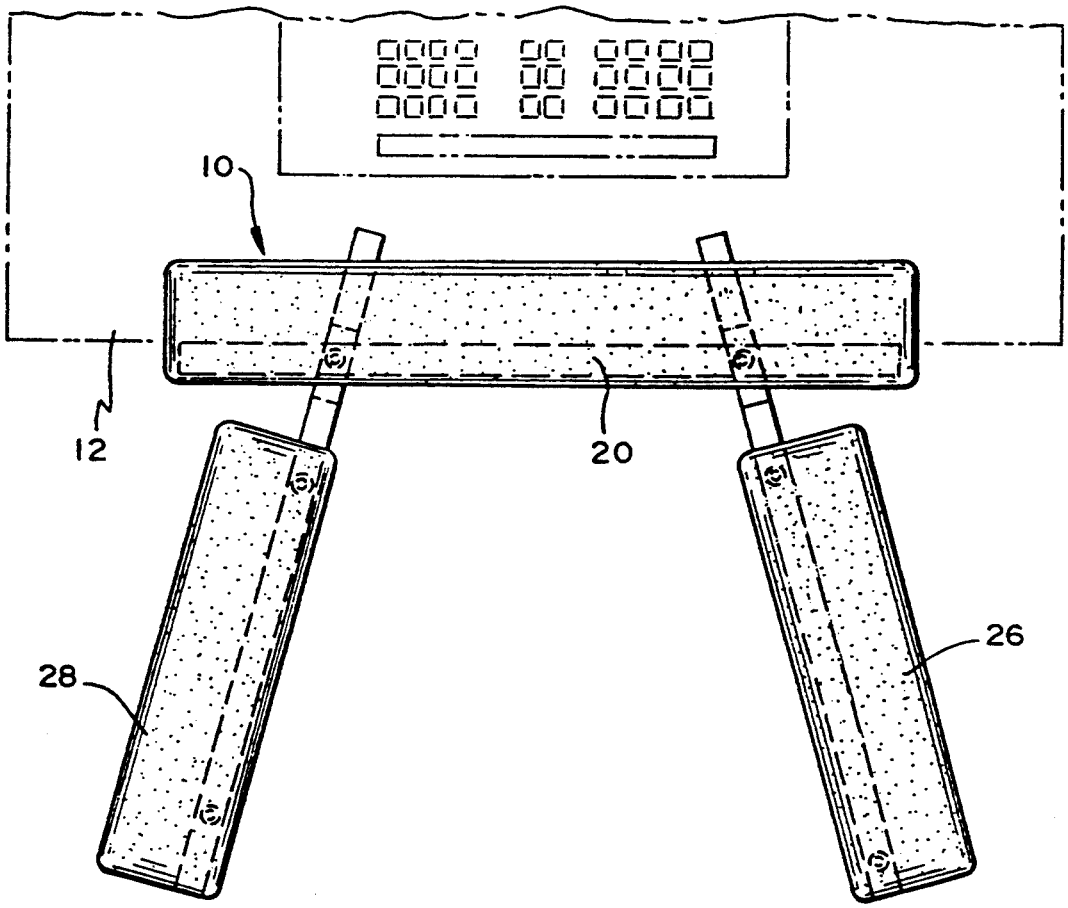
FIG. 2 is a top view of the entire wrist and forearm support apparatus of the instant invention.

Referring to FIGS. 1-3, a wrist and forearm support apparatus 10 constructed according to the invention provides support for a user while performing tasks at a desk or table 12 such as typing or data entry with a movable keyboard into a computer. While primarily intended for use at a computer terminal the wrist and forearm support apparatus constructed according to the invention can be used by other types of workers, such as persons who perform repetitive typing or data entry tasks at a typewriter or persons who perform other type of tasks at a work surface using both hands.

For supporting the user's both wrists, a cushioned wrist support member 14 is fixed in horizontal position generally parallel to the edge of the table 12. To support the user's forearms while also allowing adjustment of the forearm supports to accommodate persons of different sizes and to allow selection of the most restful, well supported positions, the invention provides a pair of cushioned armrest members 16 and 18 which are pivotably connected adjacent forward ends to the wrist support member such that both armrest members are arranged in horizontal positions and extend outwardly from the table edge at angles set by a user for maximum comfort while working. Also to provide for user comfort, a cushion 20 is attached to the top of the wrist support member which is constructed of an elongated structural element 22 which interconnects the armrest members and a bottom support element 24 to which the cushion is fastened. Similarly, the armrest support members are equipped with cushions 26 and 28, the cushions 20, 26 and 28 covering substantially the entire upper edges of the members of the embodiment of the invention shown.

Figure 4:
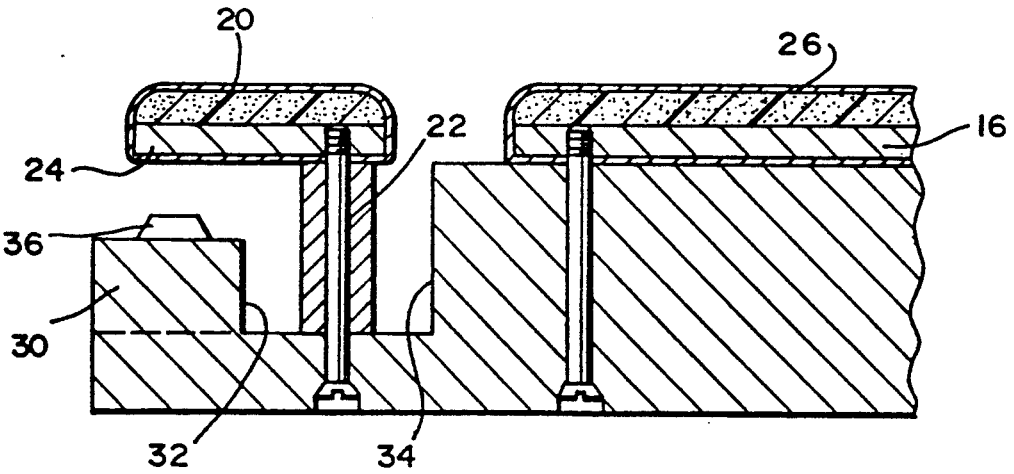
FIG. 4 is a cross-sectional view of the cushioned wrist support member of the instant invention.

In accordance with the invention, means for attaching the wrist support member and the armrest members to an edge of a table or other work surface are disposed at forward ends of the armrest members, herein shown in FIG. 3 as clamping mechanism 30. More particularly, the wrist support structural element and the armrest members are preferably constructed from a generally rectangular beam of wood which allows a relatively light, attractive unitary structure, and is readily fashioned into members having the requisite shape. To provide the clamping mechanism, as shown in FIG. 4, each armrest member is fashioned with a transverse groove along one lengthwise edge at a forward portion providing a space defined by walls 32 and 34 at which the wrist support member is connected. As shown particularly in FIG. 4, the wrist support member is fixed in the groove at a location such that there is space in the groove both in front and in back of the wrist support providing clearance for the armrest members to pivot for adjustment of their relative angular positions. This positioning relationship also results in vertical clamping space between the top of the forward end of the armrest member and the lower surface of the bottom support for the wrist support cushion. Accordingly, the wrist and forearm support apparatus can be attached to the table by aligning the vertical clamping space with the table edge and bringing the wrist and forearm support apparatus in contact with the table such that the table edge fits snugly into the clamping space. The wrist and forearm support apparatus is self-clamping due to a gravitational force resulting from the weight of the user's arms resting on the forearm support member which, through the connection with the wrist support member, is directed upward from the top of the front end of the armrest members which bear onto the under-side of the table edge. Accordingly, there is an equal and opposite force directed downward from the wrist support member onto the top of the table edge. To ensure that the table edge fits into the clamping space snugly and to provide a means for adjustment of the clamping mechanism to accommodate table edges of different thickness, resilient or hard pads 36 can be attached to the top of the forward end of each of the armrest members where it bears against the underside of the table edge, as seen in FIG. 4. The pads 36 may have a variety of thicknesses, depending upon the thickness of the table edge, and they provide a means for varying the vertical dimensions of the clamping spaces to match table edges or other types of support edges of different thicknesses.

The skilled artisan will note that the armrest members and the wrist support member can be made from wood, plastic, metal or any other rigid material that can be fashioned into the requisite structure.

If desired, the wrist support member may be constructed so that the armrest members can slide along the wrist support member in a lengthwise direction, hence, the user can adjust the horizontal spacing of the forward ends of the armrest members. In addition, it should be noted that the armrest members may be fashioned such that the groove has only one wall, as depicted in FIG. 4.

I claim:

1. An apparatus for clamping to a table to support both wrists and forearms of a person while working at the table comprising:

(a) a cushioned wrist support member;

(b) a structural element attached to said wrist support member;

(c) a pair of cushioned armrest members movably engaged with said structural element to adjust the position of said armrest members relative to each other; and (d) a pair of attachment members extending from said structural element, each attachment member having a generally planar upwardly facing surface whereby the upwardly facing surfaces and the underside of said cushioned wrist support member form a clamping mechanism for securing said wrist support member to a generally planar support.

2. A wrist and forearm support apparatus according to claim 1 further including means for varying the vertical spacing between the generally planer upwardly facing surfaces of said attachment members and said wrist support member to fit support edges of different thicknesses.

3. A wrist and forearm support apparatus according to claim 1 wherein said cushioned armrest members are pivotably engaged with said structural element.

4. A wrist and forearm support apparatus comprising:

(a) a cushioned wrist support member;

(b) a structural element attached to said wrist support member having a lengthwise dimension which is substantially equal to the lengthwise dimension of said wrist support member;

(c) a pair of spaced cushioned armrest members movably engaged to said structural element and extending generally perpendicularly from said wrist support member; and (d) a clamping mechanism consisting of a pair of attachment members which extend from said structural element and the underside of said wrist support member, where clamping is provided solely by said clamping mechanism and the gravitational force of a user's arms.

5. A wrist and forearm support apparatus according to claim 4 wherein said clamping mechanism is adjustable to fit support edges of different thicknesses.

6. A wrist and forearm support apparatus according to claim 4 wherein said cushioned armrest members are pivotably engaged with said structural element so that a user can adjust the angle at which said armrest members extend from said wrist support member.

* * * * *